United States Patent [19]

Andersen

[11] 4,355,832

[45] Oct. 26, 1982

[54] LOAD BALANCER FOR MULTIPLE LOADS

[75] Inventor: Roger E. Andersen, Ft. Walton Beach, Fla.

[73] Assignee: The United States of America as represented by the Secretary of the Air Force, Washington, D.C.

[21] Appl. No.: 212,955

[22] Filed: Dec. 4, 1980

[51] Int. Cl.[3] ..... B66C 1/10

[52] U.S. Cl. ..... 294/81 R; 294/67 R; 294/87 R

[58] Field of Search ..... 294/67 R, 67 AA, 78 R, 294/78 A, 81 R, 83 R, 86 LS, 87 R

[56] References Cited

U.S. PATENT DOCUMENTS

| | | | |
|---|---|---|---|
| 1,649,904 | 11/1927 | Longgood | 294/67 R |
| 3,056,623 | 10/1962 | Herbert | 294/83 R |
| 3,081,124 | 3/1963 | Kaplan | 294/87 R |
| 3,146,016 | 8/1964 | Daymon | 294/81 R X |
| 3,259,352 | 7/1966 | Olsen | 248/325 |
| 3,433,459 | 3/1969 | Logan | 294/81 R X |
| 3,721,416 | 3/1973 | Goudrean | 248/325 |
| 3,781,054 | 12/1973 | Cole | 294/81 R |
| 3,880,393 | 4/1975 | Watson | 248/325 |

FOREIGN PATENT DOCUMENTS

| | | | |
|---|---|---|---|
| 1058551 | 3/1954 | France | 294/81 R |

*Primary Examiner*—Johnny D. Cherry

*Attorney, Agent, or Firm*—Donald J. Singer; Stanton E. Collier

[57] ABSTRACT

An apparatus for balancing an asymmetric load of one or more large heavy objects such as missiles and the like including a rotatable horizontally oriented jack screw for moving a block with a lifting eye thereon in a lateral direction. A beam perpendicular to the jack screw holds a fixture to which one or more missiles are attached. Lateral movement of the block in response to rotation of the jack screw serves to balance the load during the hoisting and conveying operation regardless of the number and position of the missiles in the missile holding fixture.

2 Claims, 3 Drawing Figures

LOAD BALANCER FOR MULTIPLE LOADS

STATEMENT OF GOVERNMENT INTEREST

The invention described herein may be manufactured and used by or for the Government for governmental purposes without the payment of any royalty thereon.

BACKGROUND OF THE INVENTION

This invention relates to an apparatus for balancing asymmetrical loads while being lifted and, more particularly, the invention is concerned with providing load handling equipment suitable for lifting one or more large heavy objects, such as missiles and missile launchers, while at the same time maintaining the apparatus in balance regardless of the number of objects being lifted.

In the holding, hoisting and conveying of missiles, bombs and the like during loading, it is often necessary to operate with less than the full complement of elements in the holding fixture. This condition results in the load being asymmetrical causing an unbalanced state to exist which produces a relatively dangerous and unstable condition. For example, where a fixture which is designed to hold a plurality of three missiles in substantially side-by-side relationship is used to carry only one or two missiles, a critical unbalance arises. In most presently known load balancing equipment, any load unbalance is offset by a counterweight placed in some particular position on the apparatus. This procedure has many shortcomings including the fact that a number of different counterweights are needed to take care of each different load and the position of the counterweight must be accurately determined for each unbalance condition. It would be most desirable to provide an apparatus wherein the load unbalance could be corrected without the use of counterweight and without the necessity of moving counterweights to various positions on the apparatus.

SUMMARY OF THE INVENTION

The present invention is concerned with providing an apparatus for balancing multiple loads which are asymmetrical. The invention includes a laterally movable block and hoisting eye which threadably engages an elongated, horizontal jack screw. The block with the hoisting eye attached is movable along the jack screw in response to rotation thereof to a position therealong which produces a balanced load even though the objects are not symmetrical in the loading fixture. In a typical use of the load balancer, either one, two or three large missiles can be lifted, loaded and conveyed with the same apparatus by adjusting the position of the hoisting eye on the jack screw to maintain the load in balance.

Accordingly, it is an object of the invention to provide a load balancer for multiple loads wherein a plurality of large heavy objects can be safely lifted and conveyed even though the load is asymmetrical.

Another object of the invention is to provide a load handling fixture wherein a laterally movable block with a hoisting eye attached is threadably engaged with a rotatable jack screw allowing the hoisting eye to be moved therealong in order to balance the load when it is asymmetrical.

Still another object of the invention is to provide a load balancer for multiple loads wherein a hoisting eye can be adjusted laterally to provide load balancing when less than the full number of loads are in position on the loading fixture.

These and other objects, features and advantages will become more apparent after considering the following detailed description taken in conjunction with the annexed drawings and appended claims.

DESCRIPTION OF A PREFERRED EMBODIMENT

Figure 1:
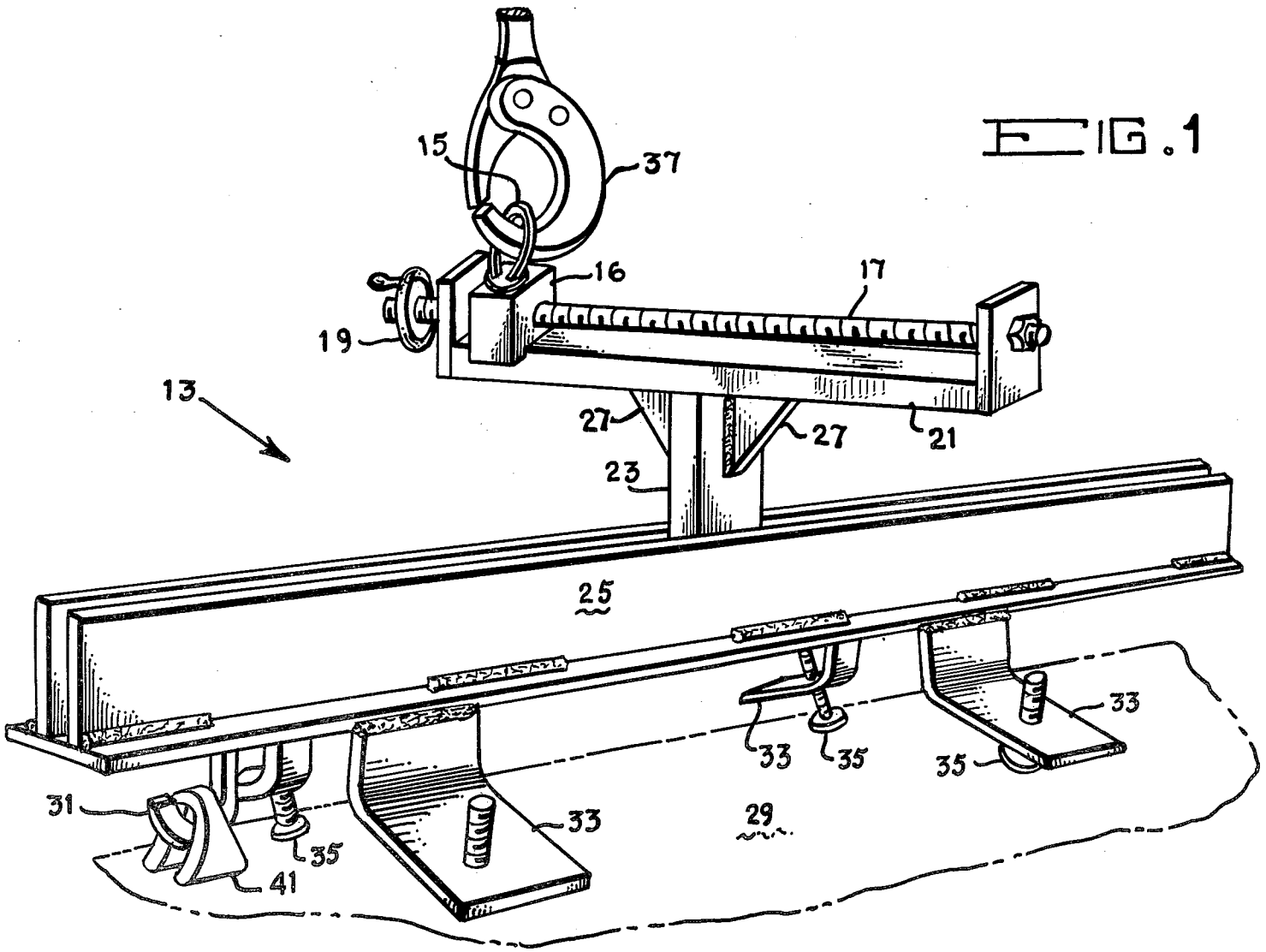
FIG. 1 is a view in perspective of the load balancer according to the invention showing the horizontal jack screw with the block and hoisting eye at one end thereof to balance an asymmetrical load.

Referring now to the Figures wherein like reference numerals refer to like elements in the several views, FIG. 1 shows load balancer 13 for lifting asymmetrical loads. The likting eye 15 attached to the block 16 can be adjusted laterally along the jack screw 17 by turning the crank 19 causing the lifting eye 15 to move along the load rail 21. A downwardly extending connector element 23 is fixedly attached at its upper end to the lower surface of the load rail 21. The lower end of the connector element 23 is attached to the elongated beam 25. Triangular reinforcing members 27 are positioned between the connector element 23 and the load rail 21.

Figure 2:
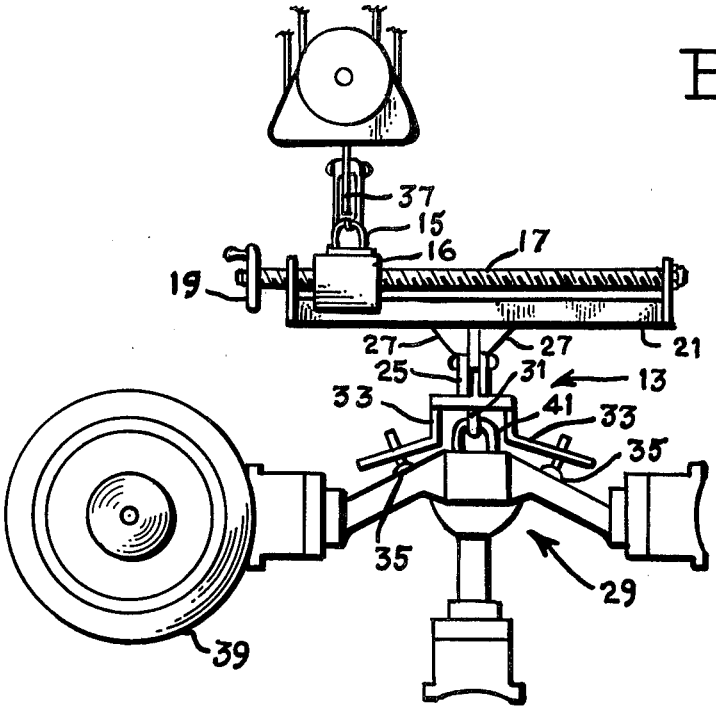
FIG. 2 is a front plan view of the load balancer of FIG. 1 holding a loading fixture designed to contain three missiles with only one missile in position thereon.
Figure 3:
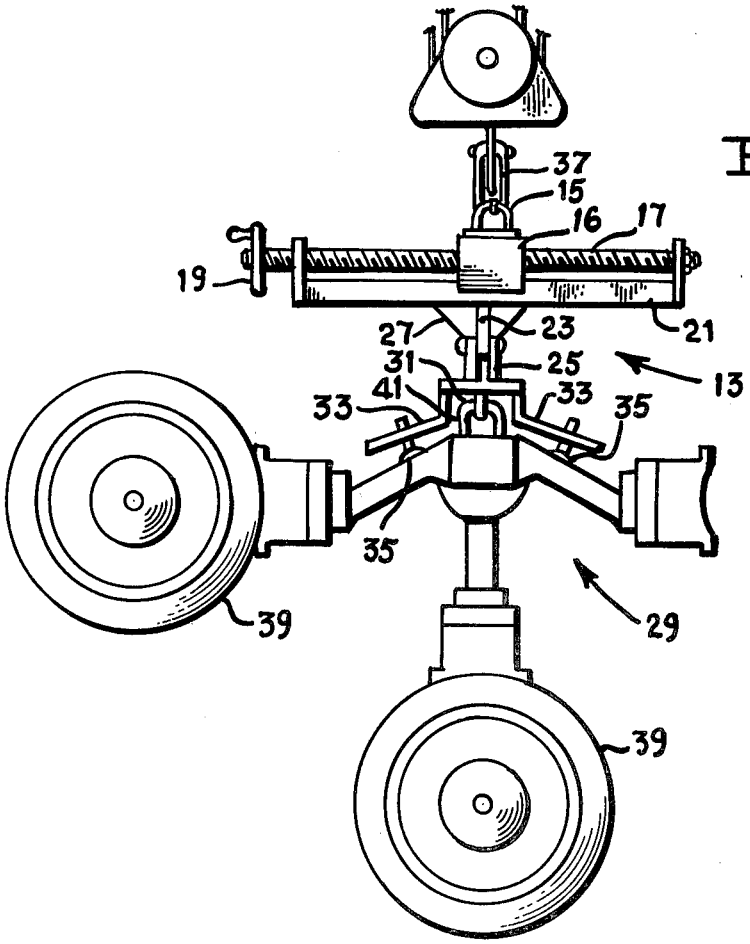
FIG. 3 is a front plan view of the load balancer of FIG. 2 with two missiles in position on the loading fixture showing the hoisting eye nearer the center of the jack screw to provide the necessary balance condition.

When the load balancer 13 is used in the preloading operation of missiles as in FIGS. 2 and 3, the fixture 29 is attached to the suspension hook 31 which extends downwardly from the lower surface of the beam 25. Two pairs of swaybraces 33 are fixedly attached to the beam 25 to extend downwardly and outwardly therefrom. Each swaybrace 33 is provided with an adjustable pad 35 for contacting the upper surface of the fixture 29 to prevent excessive swaying during the hoisting and conveying operation.

In operation, the load balancer 13 is lifted by the hook 37 which engages the lifting eye 15 attached to the laterally movable block 16. The fixture 29 with one or more missiles 39 installed thereon is attached to the beam 25 by engaging the suspension hook 31 with the lug 41 on the fixture 29. In FIG. 2 the load balancer 13 is shown with a single missile 39 attached to the left hand portion of the fixture 29 which is designed to hold a total of three missiles. With a single missile in place, the block 16 is positioned near the left hand end of the jack screw 17 so that the lifting eye 15 and the lifting hook 37 apply the lifting force to the left of center causing the load to be balanced.

In FIG. 3, two missiles 39 are installed in the fixture 29. In this condition, the crank 19 is turned until the block 16 moves toward the center of the jack screw 17 until the load is balanced. Likewise, when there are three missiles installed on the fixture 29 the crank 19 is turned until the block 16 is properly positioned to provide the needed balance to the loaded fixture. It can be seen that the jack screw 17 with the block 16 and lifting eye 15 can be adjusted to any position along the load rail 21 and therefore, any and all loads regardless of symmetry can be balanced with the load balancer 13.

Although the invention has been illustrated in the accompanying drawings and described in the foregoing specification in terms of a preferred embodiment thereof, the invention is not limited to this embodiment. It will be apparent to those skilled in the art that the hereinbefore described load balancer can be used in other operations where it is necessary and/or desirable to provide rapid balancing of asymmetrical loads, particularly loads which consist of several large heavy objects. Also, it should be noted that certain changes, modifications and substitutions can be made in the construction details of the invention without departing from the true spirit and scope of the appended claims.

Having thus set forth the nature of my invention, what I claim and desire to secure by Letters Patent of the United States is:

1. A load balancer for hoisting and conveying multiple loads comprising, an elongated rotatable horizontally oriented jack screw, said jack screw being fully threaded, a block laterally movable along the entire length of said jack screw in response to rotation thereof, a load rail for guiding the movement of said block along said jack screw, a lifting eye attached to the upper surface of said block for engagement with a hoisting hook, an elongated beam attached to and spaced below said load rail, said beam being oriented perpendicular to said load rail, and means on said beam for attaching a holding fixture thereto, said holding fixture capable of supporting said multiple loads, whereby any asymmetry of the load on the holding fixture can be balanced by laterally adjusting the position of said lifting eye on said jack screw.

2. The load balancer defined in claim 1 wherein said means for attaching the holding fixture to said beam includes a plurality of swaybraces fixedly attached to said beam and extending downwardly and outwardly therefrom, and an adjustable pad positioned on each of said swaybars, said adjustable pads contacting the surface of the holding fixture thereby preventing excessive swaying of the fixture during the hoisting and conveying operation.

* * * * *